US009630742B2

(12) United States Patent
Olvey et al.

(10) Patent No.: US 9,630,742 B2
(45) Date of Patent: Apr. 25, 2017

(54) CORRUGATED PALLET

(71) Applicants: Douglas A. Olvey, Longwood, FL (US); James L. Sketo, Longwood, FL (US); Sean G. Gumbert, Ocoee, FL (US); Joseph J. Danko, Apopka, FL (US); Christopher W. Gabrys, Reno, NV (US)

(72) Inventors: Douglas A. Olvey, Longwood, FL (US); James L. Sketo, Longwood, FL (US); Sean G. Gumbert, Ocoee, FL (US); Joseph J. Danko, Apopka, FL (US); Christopher W. Gabrys, Reno, NV (US)

(73) Assignee: Lifdek Corporation, Reno, NV (US)

( * ) Notice: Subject to any disclaimer, the term of this patent is extended or adjusted under 35 U.S.C. 154(b) by 0 days.

(21) Appl. No.: 13/261,671

(22) PCT Filed: May 20, 2013

(86) PCT No.: PCT/US2013/000137

§ 371 (c)(1),
(2) Date: Jun. 10, 2013

(87) PCT Pub. No.: WO2014/003823

PCT Pub. Date: Jan. 3, 2014

(65) Prior Publication Data

US 2015/0284137 A1 Oct. 8, 2015

Related U.S. Application Data

(60) Provisional application No. 61/664,827, filed on Jun. 27, 2012, provisional application No. 61/823,380, filed on May 14, 2013.

(51) Int. Cl.
*B65D 19/00* (2006.01)
*B65D 19/20* (2006.01)

(52) U.S. Cl.
CPC ..... *B65D 19/20* (2013.01); *B65D 19/0012* (2013.01); *B65D 2519/00019* (2013.01);
(Continued)

(58) Field of Classification Search
CPC ..... B65D 2915/00019; B65D 2915/00054; B65D 2915/00089; B65D 2915/00124;
(Continued)

(56) References Cited

U.S. PATENT DOCUMENTS 2,709,559 A 5/1955 Geisler
2,908,464 A 10/1959 Traudt et al.
(Continued)

*Primary Examiner* — Jose V Chen
(74) *Attorney, Agent, or Firm* — J. Michael Neary

(57) ABSTRACT

A corrugated paperboard pallet is produced from two flat blanks which comprise a pallet top and a pallet bottom. The two blanks are each folded to produce only two parallel vertically extending double thickness ribs, three horizontal panels, two vertical side walls and two horizontal flaps. The ribs of the pallet top and pallet bottom lock each other from opening in the center of the pallet by intersecting perpendicularly with notches in the ribs. The horizontal flaps lock the ribs from opening at the edges of the pallet by intersecting perpendicularly with notches, and the vertical sidewalls include vertical flaps that open inward defining fork passages whereby the vertical flaps lock said horizontal flaps from opening.

24 Claims, 16 Drawing Sheets

(52) U.S. Cl.
CPC ..... *B65D 2519/00054* (2013.01); *B65D 2519/00273* (2013.01); *B65D 2519/00288* (2013.01); *B65D 2519/00318* (2013.01); *B65D 2519/00333* (2013.01); *B65D 2519/00343* (2013.01); *B65D 2519/00402* (2013.01); *B65D 2519/00567* (2013.01); *B65D 2519/00985* (2013.01)

(58) Field of Classification Search
CPC ..... B65D 2915/00159; B65D 2915/00194; B65D 2915/00228
USPC ..... 108/51.3, 51.11, 56.1; 248/346.02; 206/386, 600
See application file for complete search history.

(56) References Cited

U.S. PATENT DOCUMENTS

| | | | | | |
|---|---|---|---|---|---|
| 3,026,078 | A | * | 3/1962 | Simkins | 108/51.3 |
| 3,464,370 | A | * | 9/1969 | Martin | 108/51.3 |
| 3,952,672 | A | | 4/1976 | Gordon et al. | |
| 4,875,419 | A | | 10/1989 | Helton et al. | |
| 4,936,229 | A | | 6/1990 | Parnell | |
| 5,176,090 | A | * | 1/1993 | Roberts et al. | 108/51.3 |
| 5,285,732 | A | * | 2/1994 | Gottlieb | 108/51.3 |
| 5,337,679 | A | * | 8/1994 | Moorman | 108/51.3 |
| 5,383,409 | A | * | 1/1995 | Hayakawa | 108/51.3 |
| 5,452,667 | A | * | 9/1995 | Lim | 108/51.3 |
| 5,784,971 | A | * | 7/1998 | Chang | 108/51.3 |
| 5,881,652 | A | * | 3/1999 | Besaw | 108/51.3 |
| 6,029,582 | A | | 2/2000 | Ogilvie et al. | |
| 6,116,568 | A | | 9/2000 | Rosenblat et al. | |
| 6,499,206 | B1 | | 12/2002 | Eure et al. | |
| 6,739,270 | B1 | | 5/2004 | Sewell | |
| 7,007,613 | B2 | * | 3/2006 | Sketo | 108/51.3 |
| 7,234,402 | B2 | | 6/2007 | Olvey et al. | |
| 7,303,519 | B2 | | 12/2007 | Jenkins et al. | |
| 7,426,890 | B2 | | 9/2008 | Olvey | |
| 7,472,474 | B2 | | 1/2009 | Jaen | |
| 7,484,343 | B2 | | 2/2009 | Dickner | |
| 7,980,184 | B2 | | 7/2011 | Olvey | |
| 8,033,975 | B2 | | 10/2011 | Wiklund | |
| 8,261,675 | B2 | | 9/2012 | Morris | |
| 8,365,677 | B2 | | 2/2013 | Olvey | |
| 2005/0098067 | A1 | * | 5/2005 | Sketo | 108/51.3 |

* cited by examiner

CORRUGATED PALLET

This is related to and claims priority for U.S. Provisional Application No. 61/664,827 filed on Jun. 27, 2012, and to U.S. Provisional Application No. 61/823,380 filed on May 14, 2013, and to PCT Application No. PCT/US13/00137 filed on May 20, 2013, all entitled "Corrugated Pallet".

This invention pertains to pallets for shipping goods, and more particularly to a corrugated paperboard pallet that provides strong and stiff load support, utilizing fully recyclable corrugated paperboard. The pallet reduces costs by utilizing only two flat blanks and by minimizing the amount of material required. The corrugated pallet further enables high volume production by uniquely being completely machine assemblable with a low cost machine on site at a shipping facility.

BACKGROUND OF THE INVENTION

Pallets are said to move the world. Eighty percent of commerce ships on Pallets. The pallet industry is estimated at greater than $30 B worldwide. More than 500 million pallets are manufactured in the US each year, with 1.8 billion pallets in service in the US alone.

Pallets can be made from various materials, however wood pallets currently comprise about 80% of the market. More than 40% of worldwide hardwood lumber currently goes toward the manufacturing of wood pallets. Other materials used for pallet manufacturing include plastic, metal and corrugated paperboard.

Recent regulations regarding infestation and contamination are creating a surge in interest and use of non-wood pallet alternatives. A small, but fast growing segment is the use of corrugated paperboard pallets. Many desire to replace conventional wooden pallets with corrugated pallets: increasing ability to recycle, lowering pallet weight, eliminating product contamination, reducing pallet storage volume and reducing pallet related injuries.

Many different designs of corrugated paperboard pallets have been developed to date. Despite the potential advantages of corrugated pallets, most have suffered from several different deficiencies. These deficiencies include low strength and stiffness, high use of corrugated paperboard, resulting in high material costs, along with high overhead, assembly labor and freight costs. The inherent inability to readily produce and distribute corrugated pallets in sufficiently high volume has also been of critical importance.

Accordingly, a new corrugated pallet is needed that can provide increased strength and stiffness for use in widespread shipping, minimize corrugated use for low material costs, and that can be readily produced for the high volume consumables market, while reducing logistics costs.

SUMMARY OF THE INVENTION

The invention provides a corrugated paperboard pallet that has high strength and stiffness and is produced using a minimal amount of paperboard material, reducing material costs. The pallet is constructed from only two die cut blanks. Of unique importance, the blanks may be shipped knock down flat directly from a corrugator to a shipper for simple and rapid assembly on site. The design of the corrugated pallet enables 100% machine assembly using a relatively compact, low cost and reliable assembly machine. These factors enable the corrugated pallets to be readily produced in high volume for future widespread use.

The corrugated paperboard pallets are produced from two flat blanks which comprise a pallet top and a pallet bottom. The blanks are each folded to produce only two parallel, vertically extending, double thickness ribs, three horizontal panels, two vertical side walls and two horizontal flaps. The ribs of the pallet top and the pallet bottom lock each other from opening in the center of the pallet by intersecting perpendicularly with notches. The intersection of the ribs prevents any of the ribs from flattening out. The horizontal flaps lock the ribs from opening at the edges of the pallet by intersecting perpendicularly with notches. The vertical sidewalls comprise vertical flaps that open inward defining fork passages whereby the vertical flaps lock the horizontal flaps from opening.

We have found that it is desirable to have only two ribs as opposed to three or more per blank in a corrugated paperboard pallet for several reasons. One reason is that having only two ribs can greatly simplify the construction of an assembly machine to assemble the pallets. Machine assembly of the pallet can be accomplished by clamping a blank on opposite sides of a rib to be formed and bringing opposite sides together. Using more than two ribs per blank will require both horizontal sides of a single rib to move. This makes assembly very complicated, expensive and less reliable. With only two ribs per blank, one side of each rib may be held fixed such that motion is not required on both sides. We have found that if a pallet could be designed to be structurally sound using only two ribs per blank, this would dramatically simplify the construction of a pallet assembly machine.

A second reason that the use of only two ribs per blank in a corrugated pallet design is preferable is because it reduces the area of corrugated board used in the pallet. We have found that a design with two ribs per pallet blank can reduce raw material costs by 20% per pallet when compared to a corrugated pallet design with four ribs per pallet blank. We have found that it is possible to meet the requirements of at least 70% of the shipping market, namely fast moving consumables, with a two rib per blank pallet by using features described herein.

A pallet is used for shipping and supporting loads above floor level by vertically transferring load from the pallet top to the pallet bottom. The notches in the ribs are preferably dimensioned so that the tops of the bottom ribs contact the underside of the pallet top, and the bottom edges of the top ribs contact the top side of the pallet bottom, optimizing vertical support of the pallet top against vertical loads of the cargo placed on the pallet. An additional benefit of the vertical flaps of the sidewalls is that they define the outer edges for easy fork entry either by a fork lift or pallet jack operator. In a further embodiment, the vertical flaps of the sidewalls can provide additional transfer of load between the pallet bottom and the pallet top. These vertical flaps increase the working load capacity and rating of the corrugated paperboard pallet.

Pallets support loads at rest, allow loads to move while supported on forks, and they can also support loads in motion by the pallet moving over rollers. Additionally, loads may move relative to a pallet when the pallet is being loaded and unloaded. For these reasons, it is preferable that the top and bottom surfaces be smooth. In an additional embodiment of the invention, the adjacent panels of the three horizontal panels of the pallet top and the pallet bottom abut each other without overlapping and the ribs are locked without the use of adhesive. Particularly, it is desirable to have panels that do not overlap on the top and bottom surfaces of the pallet. With the horizontal panels abutting without overlapping, no protruding ledges are produced that could hang up motion of loads on the pallet during loading and unloading. Likewise, the pallet's smooth surfaces enables ease of travel over rollers, if and when required.

It is desirable to eliminate the use of adhesive in the pallet assembly because adhesives increase costs, increase complexity and reduce reliability of the pallet assembly machinery and they can make the pallet assembly messy. It is preferable to lock the vertically extending ribs of the pallet without the use of adhesives. This can be accomplished without overlapping horizontal panels through the use of the locking center and edge notches of the corrugated pallet.

It is desirable to make as strong a pallet as possible, but at the same time it is desirable to minimize the amount of paperboard used, in order to minimize raw material cost. One of the most difficult loading conditions of a corrugated pallet is an unbalanced weight distribution, causing torsion or bending. Handling these conditions using minimal material in the pallet is a goal of corrugated paperboard pallet design. In yet a further embodiment of the invention, the strength and torsional stiffness are greatly increased in these loading conditions by overlapping the corners of the horizontal flaps over the pallet top and the pallet bottom and locking into the pallet top and the pallet bottom from the top and bottom surfaces of the pallet. These corner straps have been found to increase the torsional stiffness and strength of the corrugated pallet by more than 85%. Locking into the top and bottom makes the top and bottom surfaces at the corners not smooth, however the increased load capacity and structural integrity gained outweighs this deficiency. Prior art methods of locking a pallet top to a pallet bottom through the use of straps that locked on the sidewalls, instead of the top and bottom surfaces of the pallet, resulted in flat pallet blanks that were not rectangular and had protruding elements. We have found that these protruding elements on the blanks make shipping the blanks difficult and unreliable because they are very easily damaged in shipping, even when blanks are shipped in stacks. Designs with these protruding elements require greater areas of material and more waste. The protruding elements can easily snag, making them incompatible with simple and reliable machine assembly of the pallet. The invention uniquely overcomes these issues by utilizing the corners of the horizontal flaps overlapping the pallet top and the pallet bottom and locking into the pallet top and the pallet bottom from the top and bottom surfaces of the pallet.

In all conditions where the pallet is not being lifted, the load is being transferred from the top surface of the pallet to the bottom surface of the pallet, typically residing on the floor. This transfer of load is facilitated by the vertical ribs, vertical sidewalls and vertical flaps. The compression strength of the vertical members directly impacts the ability to transfer load. Because of the pallet design, the rib direction and sidewall direction are both the same, therefore the higher compression strength direction of the corrugated paperboard can be utilized advantageously. Accordingly, the higher compression strength direction of the paperboard, the cross machine direction, preferably aligns vertically in these sections and is perpendicular with the direction of the ribs across the pallet tops and bottoms. In an additional embodiment of the invention, the cross machine direction of the corrugation of the pallet top and the pallet bottom is made perpendicular to the direction of their respective ribs.

Besides high torsion stiffness, strength for lifting unbalanced loads, locking the pallet top to the pallet bottom provides other benefits. These benefits include reliability and resistance against the pallet loosening from vibration during shipping. Having a portion of the horizontal flaps to overlap the pallet top and pallet bottom of the pallets and lock in from the top and bottom surfaces of the pallet, whether at the corners or other positions along the edge, greatly increases the structural strength and reliability of the pallet. In further embodiments, the added locking of the pallet top to the pallet bottom can occur in any locations along the sidewall edges. In this embodiment, the horizontal flaps lock the ribs from opening at the edges of the pallet by intersecting perpendicularly with notches in the rib ends, and a portion of the horizontal flaps overlap the pallet top and the pallet bottom and lock into the pallet top and the pallet bottom from the top and bottom surfaces of the pallet.

The distributed load carrying capacity of a corrugated paperboard pallet is a function of the plate bending stiffness of the top and bottom surfaces and also primarily the rib and sidewall support that transfers load between the pallet top and pallet bottom. It is desirable to minimize the number of vertical ribs and use only two vertical ribs per pallet top and per pallet bottom so that paperboard use is minimized along with costs, as well as simplifying assembly machine construction. Fewer vertical ribs resultantly and undesirably increases the span between ribs, but we have found that a two rib per top and bottom pallet design can meet the needs of the majority of shipping requirements if the width of the ribs are correctly proportionate to the width of the pallet sidewalls, and if the corrugated board has a sufficient non-crushed total flute thickness. In an additional embodiment of the invention, the pallet top and the pallet bottom each have a non-crushed total flute thickness of greater than 5.6 mm, and each of the pallet top and the pallet bottom has an outside width of the ribs that is greater than $1/8^{th}$ the outside width of their respective sidewalls.

In the construction of corrugated paperboard pallets, it is desirable to design the pallet so that it maintains integrity throughout shipping and handling conditions. We have found that one way to accomplish this goal is to design the pallet to utilize a multiple series of locks. For instance, one set of folds is locked by a lock, then a second lock prevents unlocking or disassembly of the first lock and so on. In this way, the pallet is not easily disassembled nor is it likely to fail in use. In an additional embodiment, portions of each blank engages the other blank to form locks that hold the pallet top and the pallet bottom in an integral locked-together pallet, and at least some of the locks arranged in series of at least three locks, such that a first lock is in turn locked against disengaging by a second lock, and the second lock is in turn locked against disengaging by a third lock. These locks in series are preferably geometrical mechanical locks, meaning that they can lock without the use of added adhesives.

In yet a further embodiment of the invention, the blanks are folded together to produce the pallet whereby folds are locked from opening by serial geometric mechanical locks having a series of greater than two. In the pallet shown, there are four locks in series holding the pallet together. The top blank ribs are locked from opening by the bottom blank ribs. The top blank horizontal flaps lock the bottom blank ribs from opening. The top blank vertical flaps lock the top blank horizontal flaps from opening. The corner straps hold the pallet top and bottom together, thereby locking the top blank vertical flaps from opening.

DESCRIPTION OF THE DRAWINGS

The invention and its many advantages and features will become better understood upon reading the following detailed description of the preferred embodiments in conjunction with the following drawings, wherein.

DESCRIPTION OF THE PREFERRED EMBODIMENT

Figure 1:
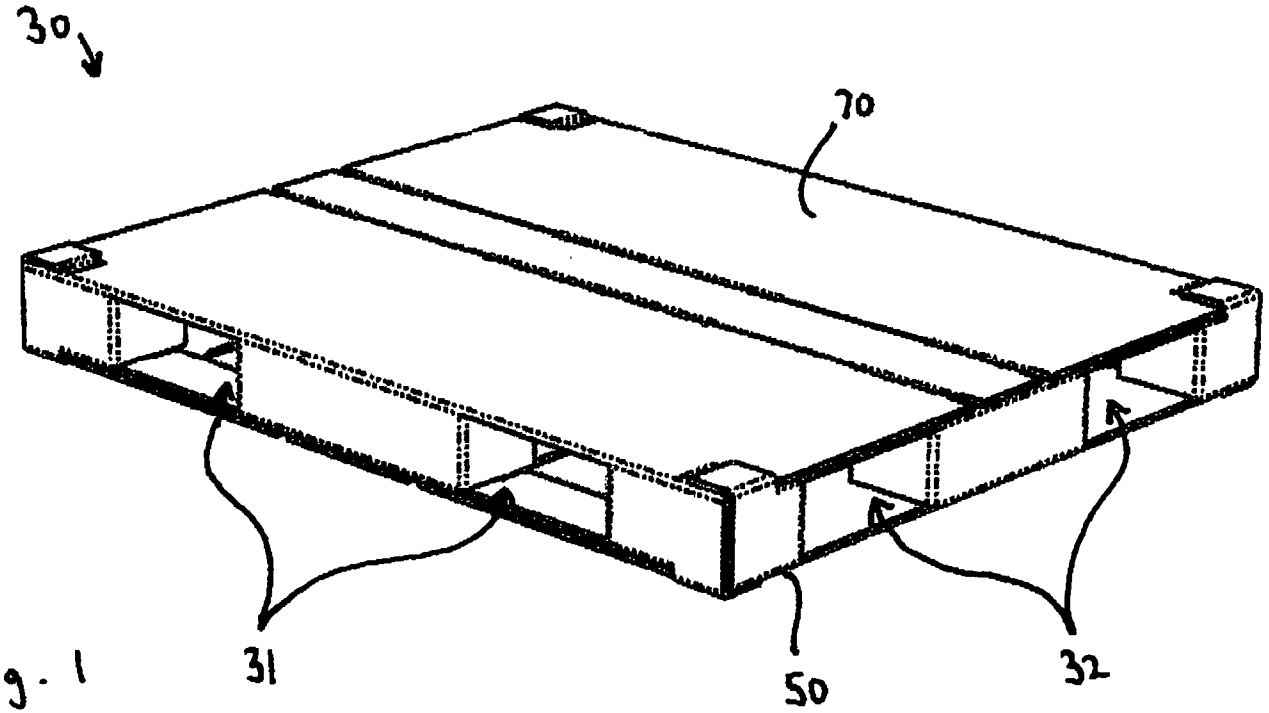
FIG. 1 is a schematic drawing of a corrugated paperboard pallet in accordance with the invention.

Turning to the drawings, wherein like reference characters designate identical or corresponding parts, FIG. 1 shows a corrugated paperboard pallet 30 in accordance with the invention. The pallet 30 has fork passages 31, 32 for lifting and moving the pallet when loaded with shipping goods. The pallet 30 is compromised of a pallet bottom 50 and a pallet top 70 that are comprised of sheets of corrugated paperboard.

Figure 2:
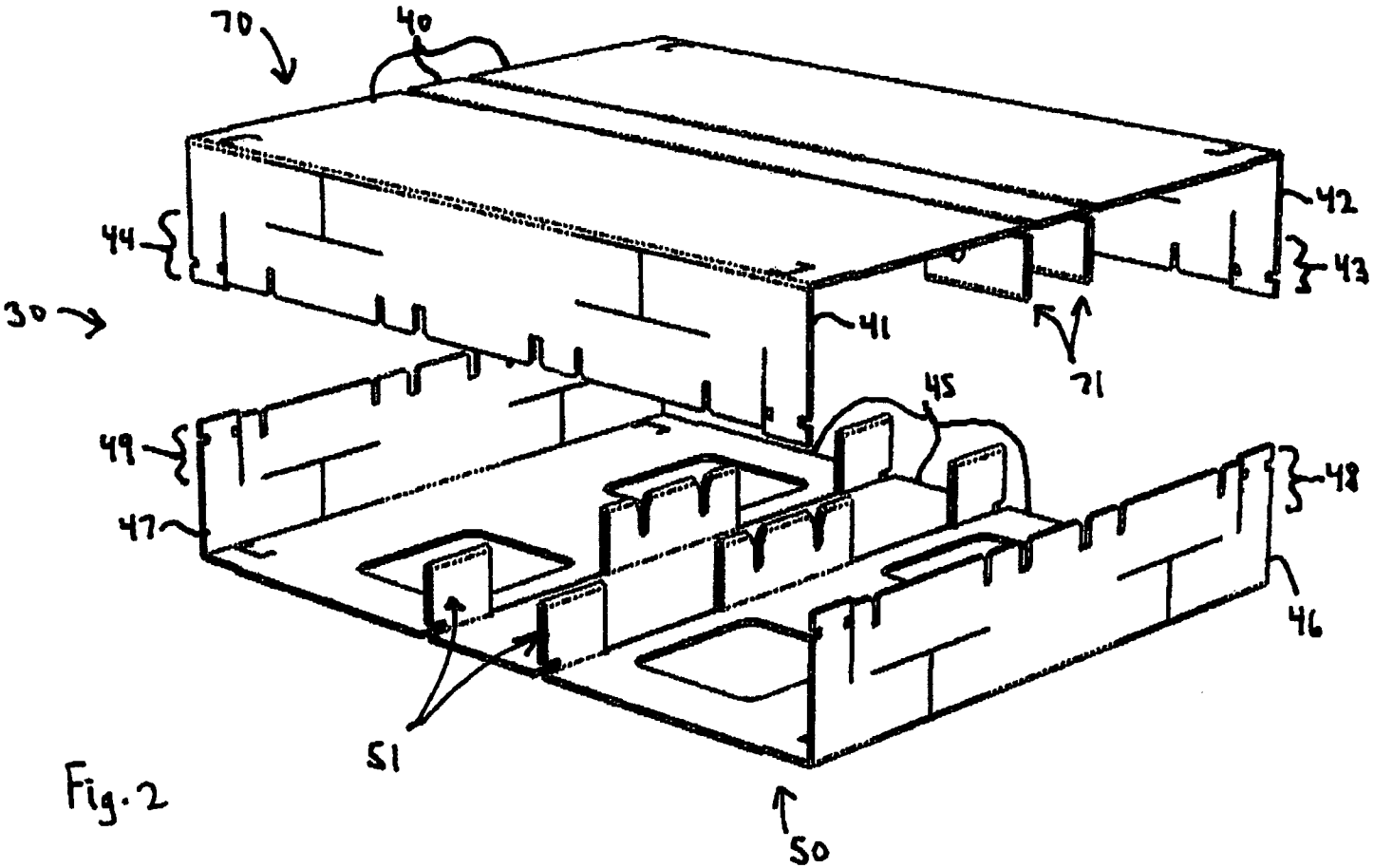
FIG. 2 is a schematic drawing of the pallet of FIG. 1 in partially folded but unassembled state, in accordance with the invention.
Figure 6A:
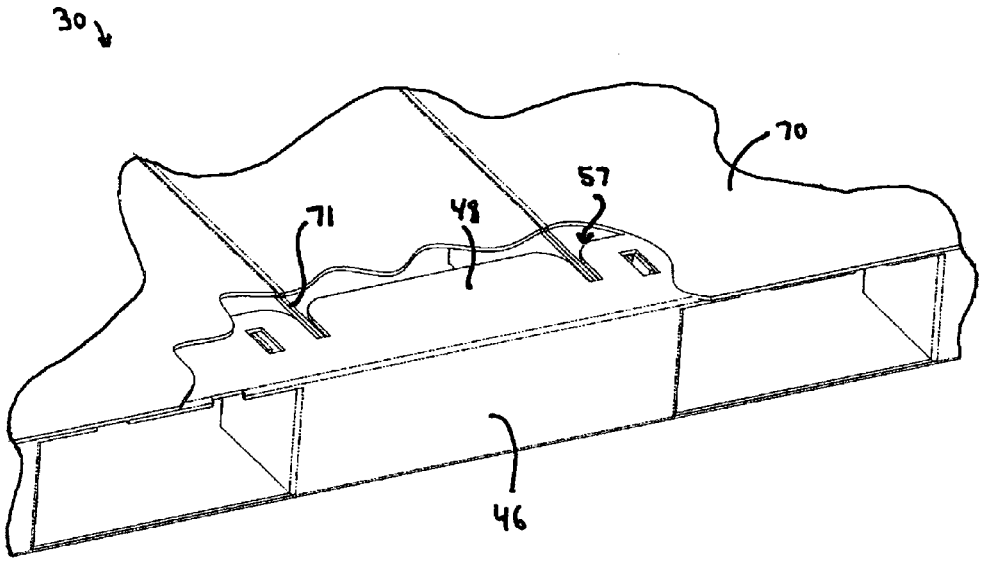
FIG. 6A is a cut-away perspective view of one end of the pallet of FIG. 1, showing how the horizontal flap is tucked under the top sheet, with slots engaging the ribs to hold them closed and to hold the top and bottom panels together.
Figure 7:
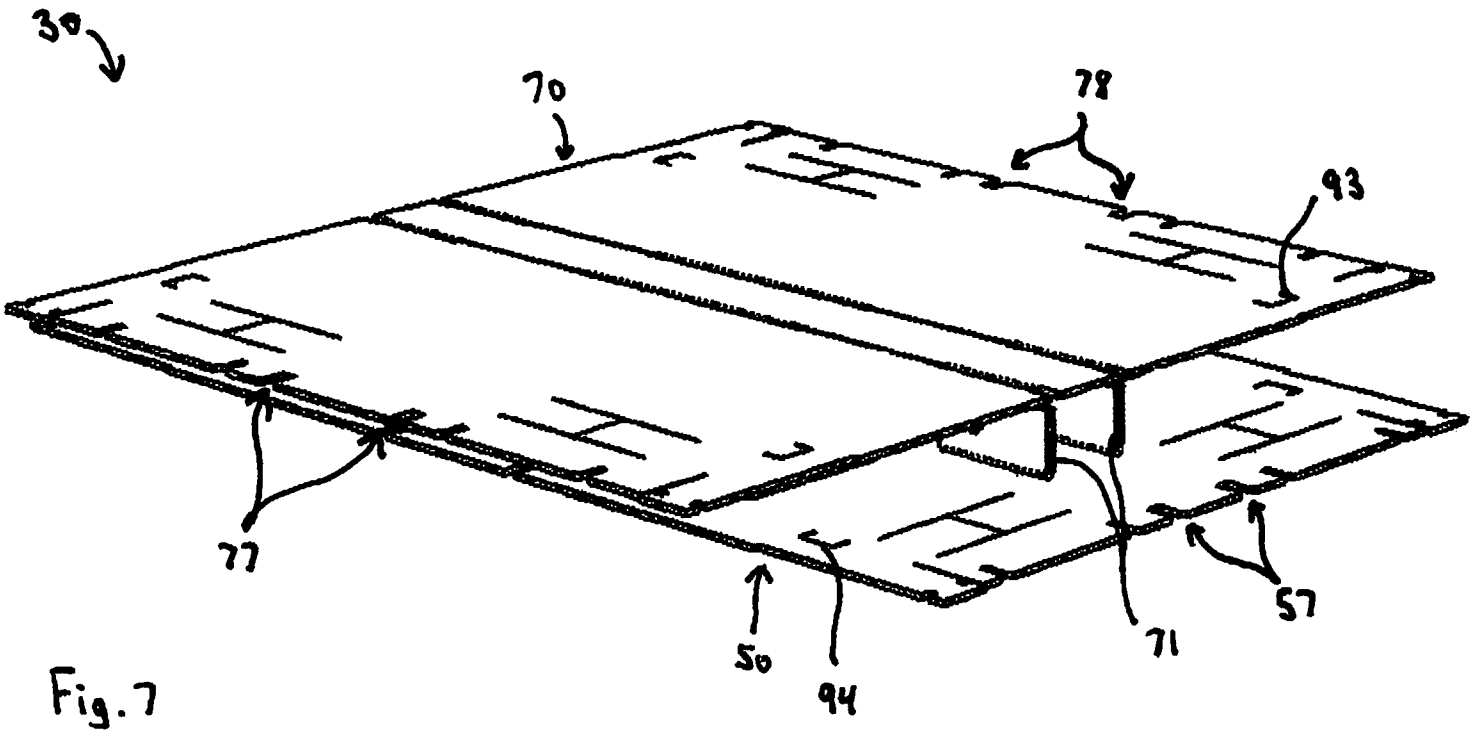
FIG. 7 is a schematic drawing of the pallet bottom and pallet top of the pallet of FIG. 1 in the assembly process after being compressed together in accordance with the invention.
Figure 7A:
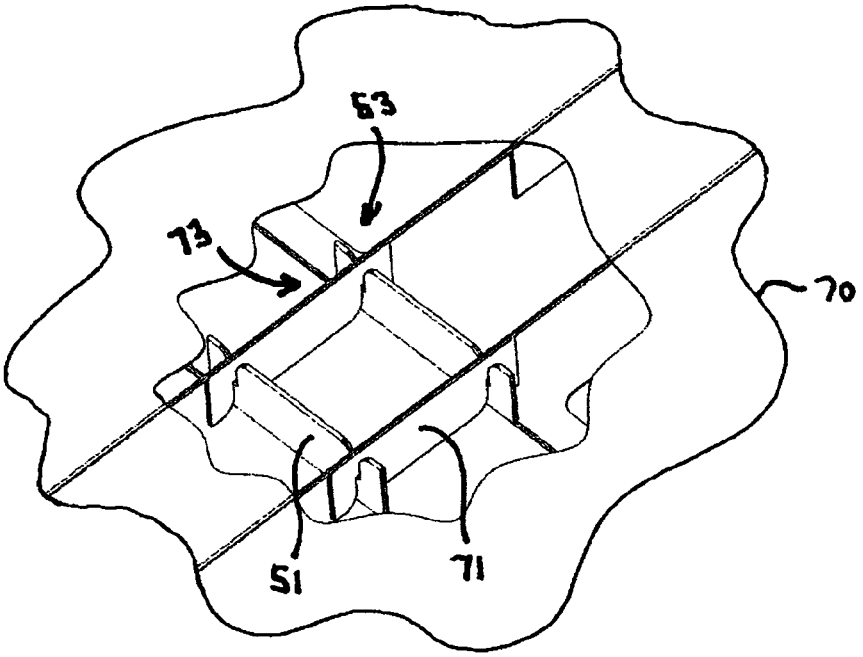
FIG. 7A is a cut-away perspective view of the pallet of FIG. 1, showing the inter-engagement of the intersecting ribs in the central area of the pallet.

A schematic drawing of the pallet of FIG. 1 in partially folded but unassembled state, in accordance with the invention is shown in FIG. 2. The corrugated paperboard pallet 30 is produced from two flat blanks which comprise a pallet top 70 and a pallet bottom 50. The blanks 70, 50 are each folded to produce only two parallel vertically extending double thickness discontinuous ribs 71 and 51, three horizontal panels 40 and 45, two vertical side walls 41, 42, 46, 47 and two horizontal flaps 43, 44, 48, 49. The ribs 71 of the pallet top 70 and the ribs 51 of the pallet bottom each have a central portion and two rib ends. The central portions of the ribs 51 and 71 lock each other from opening in the center of the pallet 30 by intersecting perpendicularly with notches 53, as shown in FIG. 7A. As shown in FIG. 6A, when completely assembled, the horizontal flaps 43, 44, 48, 49 lock the end portions of the ribs 71, 51 from opening at the edges of the pallet 30 by intersecting perpendicularly with notches 57, 58, 75, 55, 77. The vertical sidewalls 41, 42, 46, 47, once assembled, have vertical flaps 59, 79 that open inward defining fork passages whereby the vertical flaps lock horizontal flaps 43, 44, 48, 49 from opening.

Figure 3:
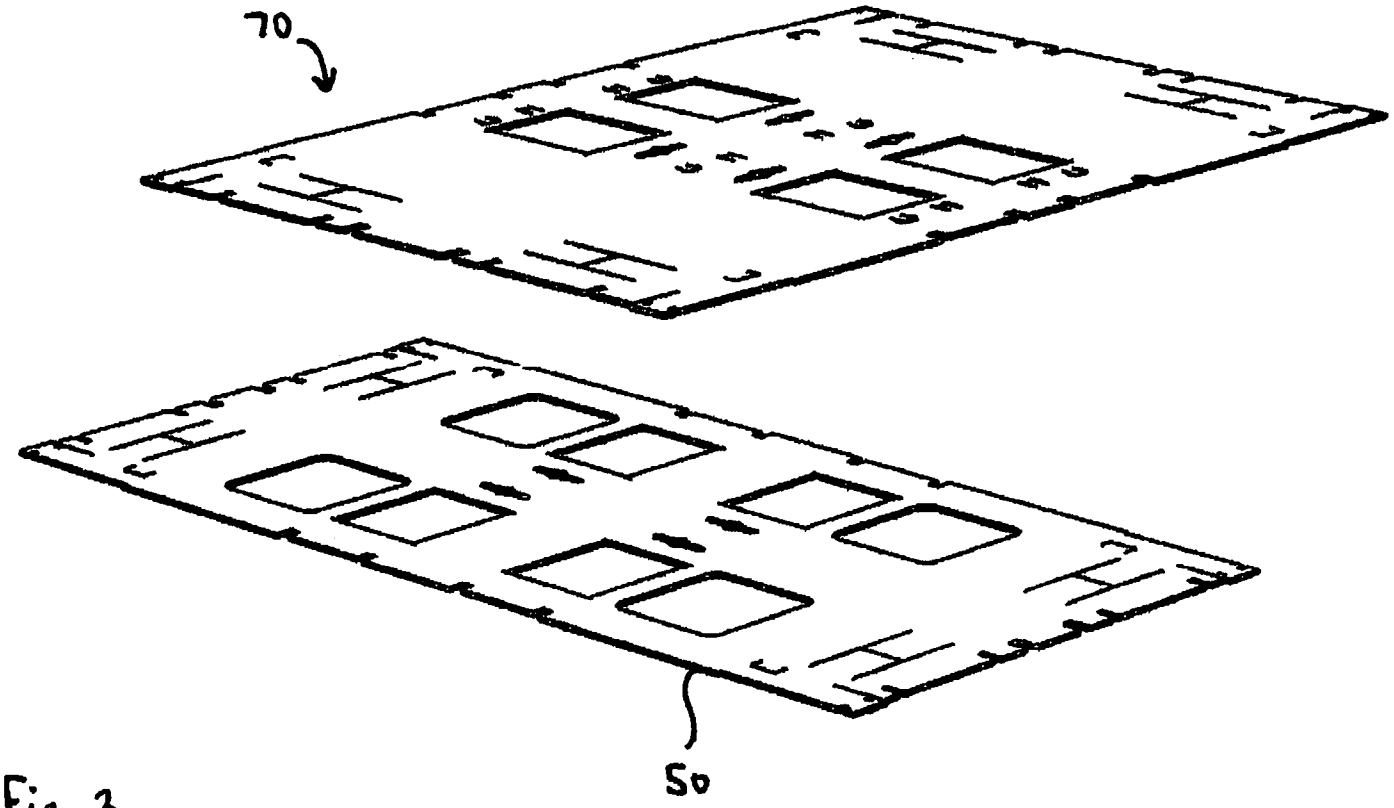
FIG. 3 is a schematic drawing of the pallet of FIG. 1 prior to assembly in flat blanks state in accordance with the invention.

A schematic drawing of the pallet of FIG. 1 prior to assembly in flat blanks state in accordance with the invention is shown in FIG. 3. The pallet 30 is produced from two flat, die cut corrugated paperboard blanks that produce the pallet top 70 and pallet bottom 50. To facilitate shipping, it is preferable that the blanks 50, 70 be shipped flat to the shipper site such that more blanks can fill a truckload.

Figure 4:
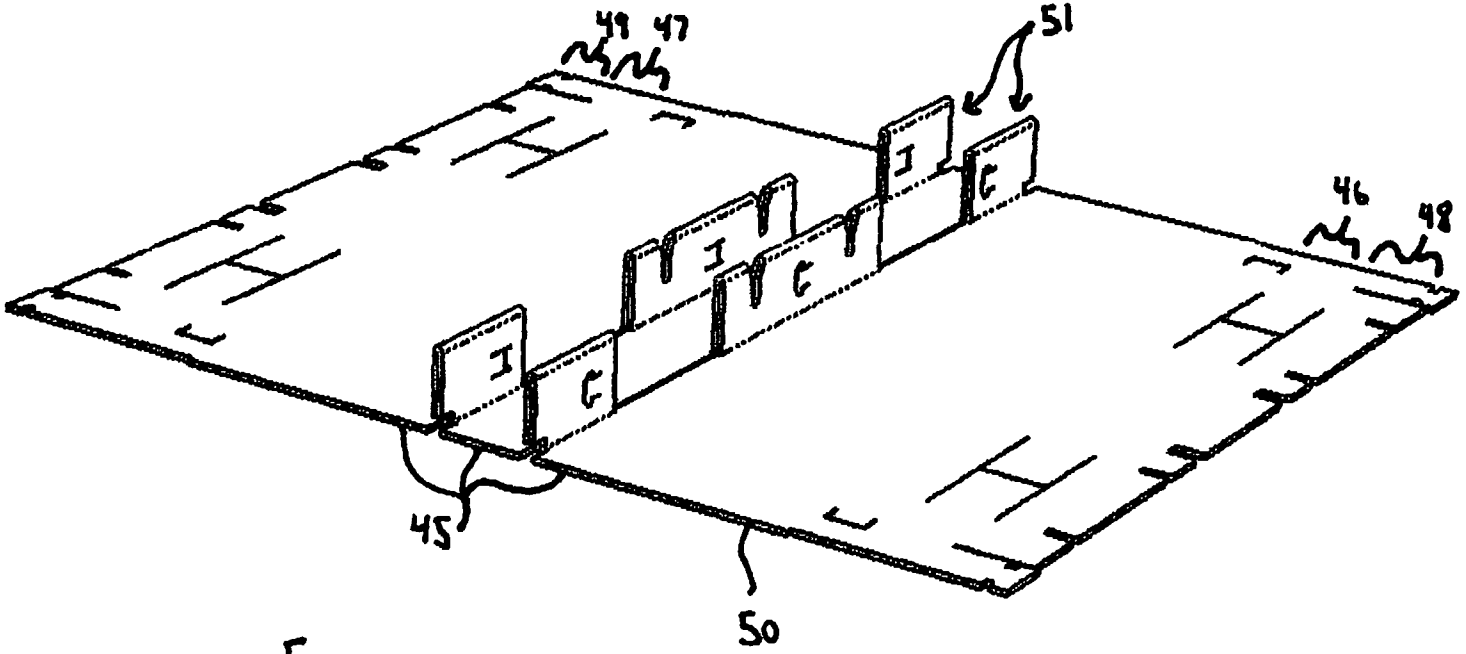
FIG. 4 is a schematic drawing of the pallet bottom of the pallet of FIG. 1 in the assembly process with ribs folded up in accordance with the invention.

The pallet bottom of the pallet of FIG. 1 is shown in the assembly process with ribs folded up in FIG. 4. The pallet bottom 50 is folded to produce only two vertically extending double thickness discontinuous ribs 51 near the longitudinal center, three horizontal panels 45, two sidewalls 46, 47 that will be vertical in the assembled pallet and two horizontal flaps 48, 49.

Figure 5:
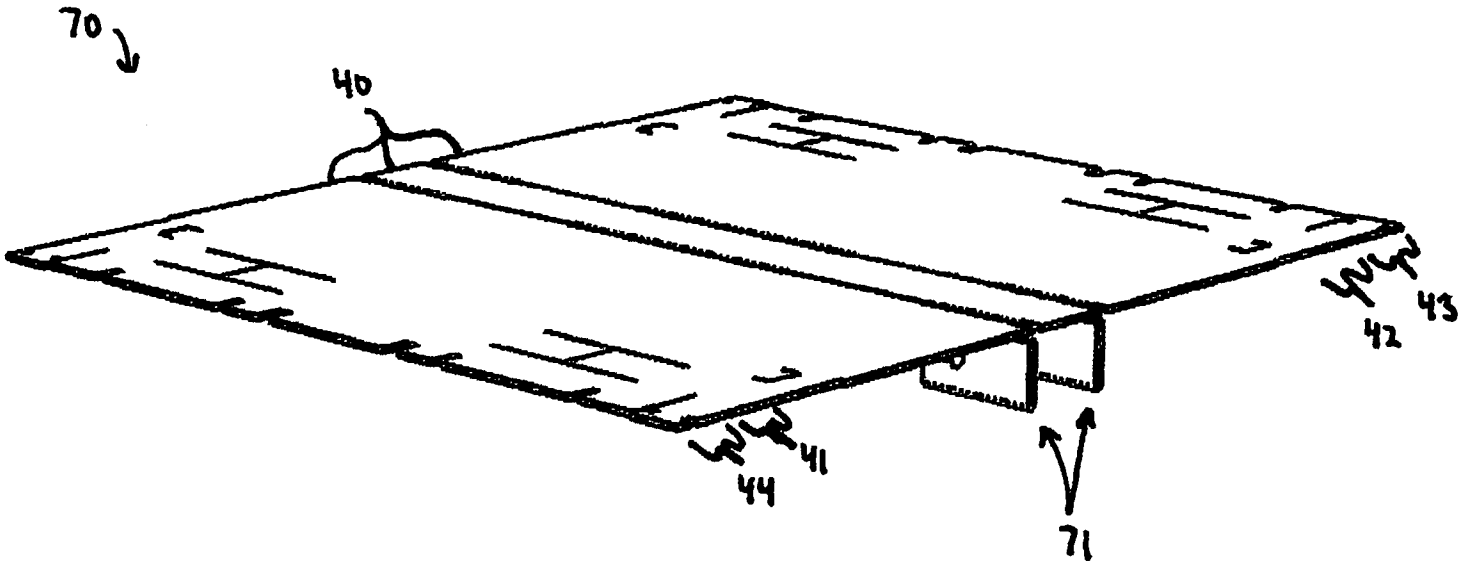
FIG. 5 is a schematic drawing of the pallet top of the pallet of FIG. 1 in the assembly process with ribs folded down in accordance with the invention.

The pallet top of the pallet of FIG. 1 is shown in the assembly process in FIG. 5 with ribs 71 folded down. The pallet top 70 is folded to produce only two vertically extending double thickness discontinuous ribs 71 near the longitudinal center, three horizontal panels 40, two sidewalls 41, 42 that will be vertical in the assembled pallet and two horizontal flaps 43, 44.

Figure 6:
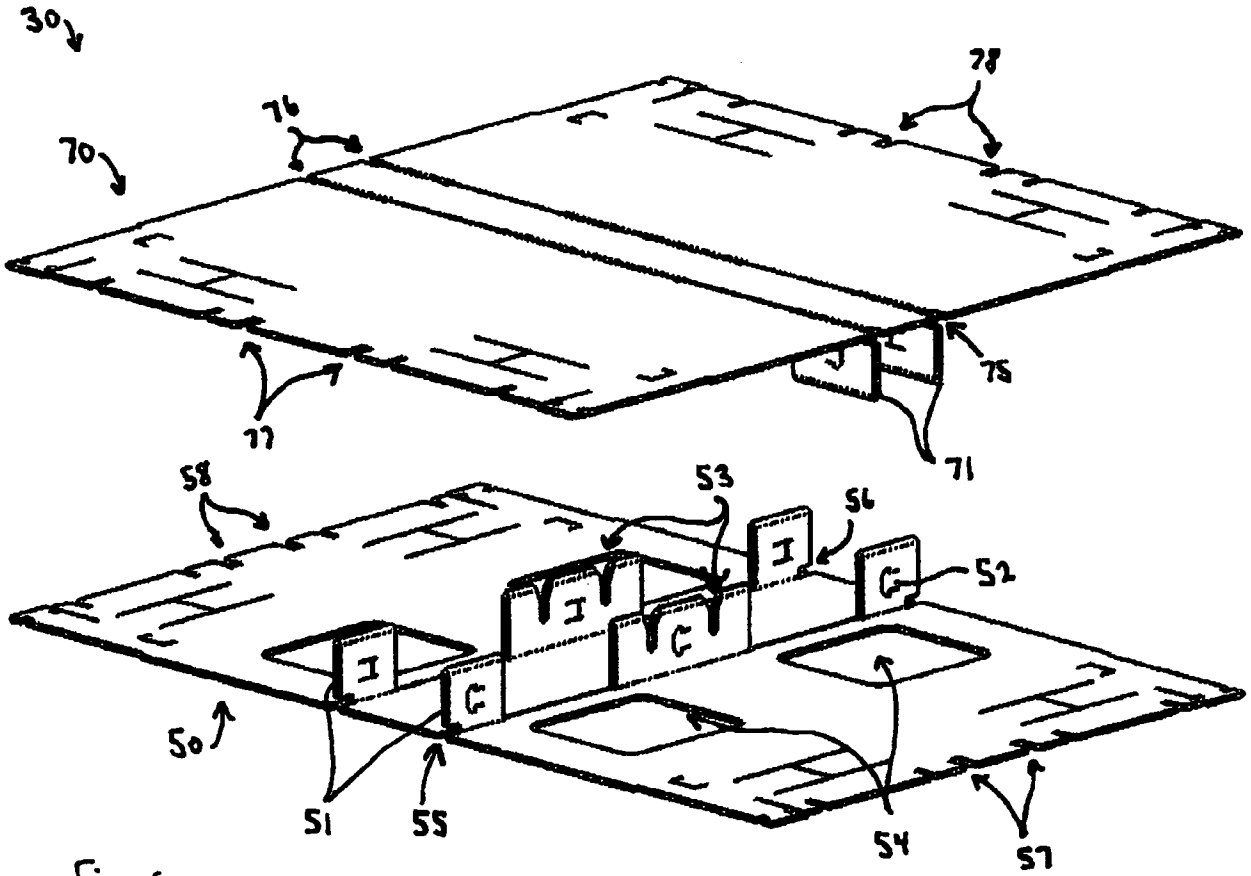
FIG. 6 is a schematic drawing of the pallet bottom and pallet top of the pallet of FIG. 1 in the assembly process aligned prior to compression together in accordance with the invention.

A schematic drawing of the pallet bottom and pallet top of the pallet of FIG. 1 in the assembly process aligned prior to compression together in accordance with the invention is shown in FIG. 6. The pallet 30 is assembled by rotating the pallet top 70 and pallet bottom to be perpendicular with each other and aligned such that ribs 71, 51 cross and nest in notches 53, as illustrated in FIG. 7A. The pallet bottom 50 has openings 54 for pallet jack wheels, should a pallet jack be used to lift and move the finished pallet 30. The ribs 51, 71 are preferably locked without the use of adhesive. The ribs 51, 71 may be mechanically locked during the intermediate step before assembly of the pallet top 70 with pallet bottom, through the use of rib punch locks 52. However, for simplicity and strength, preferably no rib punch locks are utilized and ribs 51, 71 are locked closed by each other in the center when assembled together using notches 53. The end portions of the ribs 51, 71 are later locked by notches 57, 58 with 75, 76 and with 77, 78 with 56, 56.

One end of the pallet of FIG. 1, shown in FIG. 6A, illustrates how the horizontal flap 48 of the pallet bottom 50 is tucked under the pallet top 70, with notches 57 engaging the top of the ribs 71 to hold them closed and to lock the top and bottom panels against separating. We have found it to be desirable that the pallet be designed so that it maintains integrity throughout shipping and handling vibration and loading conditions. We have found that one way to accomplish this goal is to design the pallet using multiple series locks. For example, the top blank ribs 71 are locked from opening by the bottom blank ribs 51. The top blank horizontal flaps 43, 44 lock the bottom blank ribs 51 from opening. The top blank vertical flaps 79 lock the top blank horizontal flaps 43, 44 from opening. The corner straps 91, 92 clamp the pallet top and bottom together, thereby locking the top blank vertical 79 flaps from opening.

Once aligned, the pallet top 70 and pallet bottom 50 are compressed together. A schematic drawing of the pallet bottom and pallet top of the pallet of FIG. 1 in the assembly process after being compressed together in accordance with the invention is shown in FIG. 7. The pallet 30, in compressed stated, is shown in FIG. 7. Horizontal flaps 48, 49, are ready to be folded to engage the notches 57, 58 with the notches 75 on the rib ends of the ribs 71 to lock the edges of ribs 71 closed, and the horizontal flaps 43, 44 are ready to be folded to engage the notches 77, 78 with the notches 55, 56 on the rib ends of the ribs 51 to lock the edges of ribs 51 closed.

Figure 8:
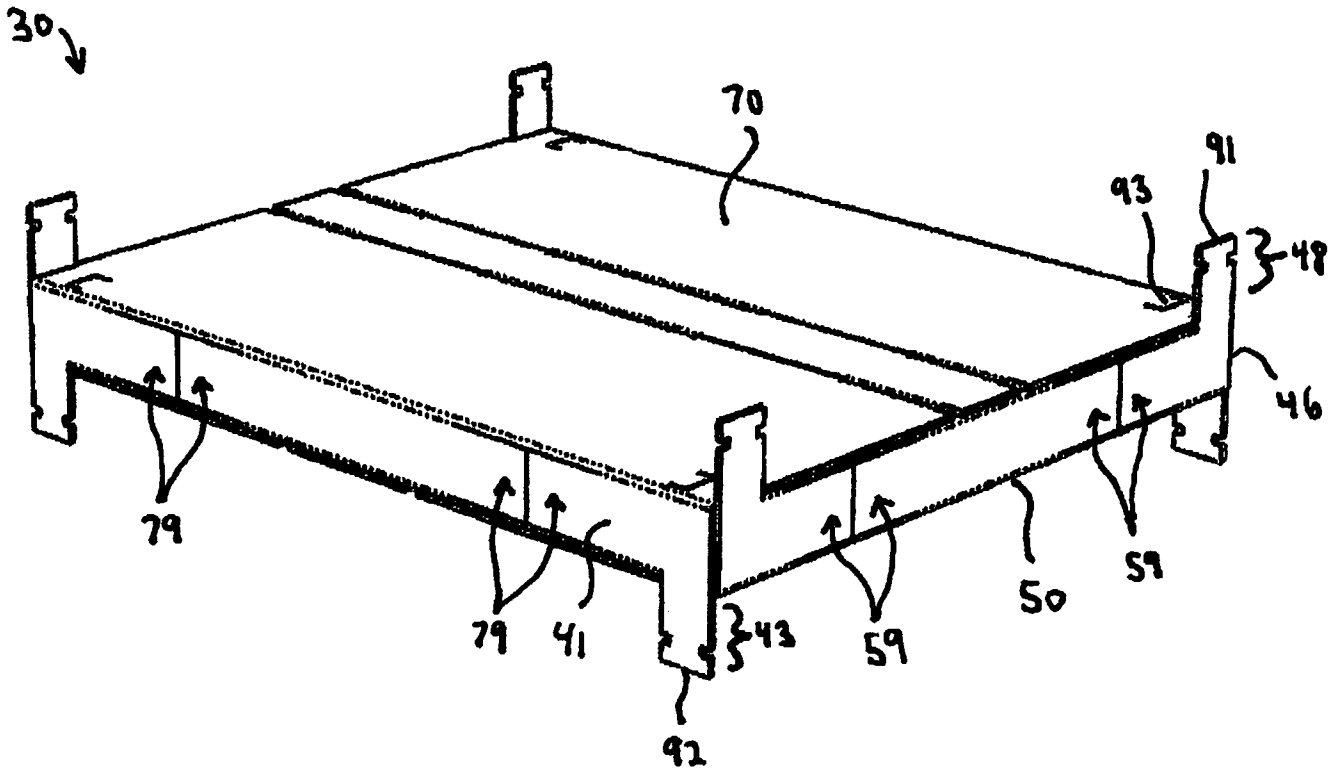
FIG. 8 is a schematic drawing of the pallet of FIG. 1 in the assembly process after the horizontal flaps have been inserted in accordance with the invention.

A schematic drawing of the pallet of FIG. 1 in the assembly process after the horizontal flaps have been inserted in accordance with the invention is shown in FIG. 8. The pallet 30 has the pallet top 70 and pallet bottom 50 locked together by the sidewalls 41 and 46 being folded vertical and horizontal flaps 43, 48 locking the edges of the end portions of the ribs 71, 51. The corner straps 91, 92 of the horizontal flaps 43, 48 are not assembled yet and will later be locked to the pallet top 70 and pallet bottom 50 through slots 93. Vertical flaps 59, 79 on the sidewalls 41, 46 are ready to be assembled.

Figure 9:
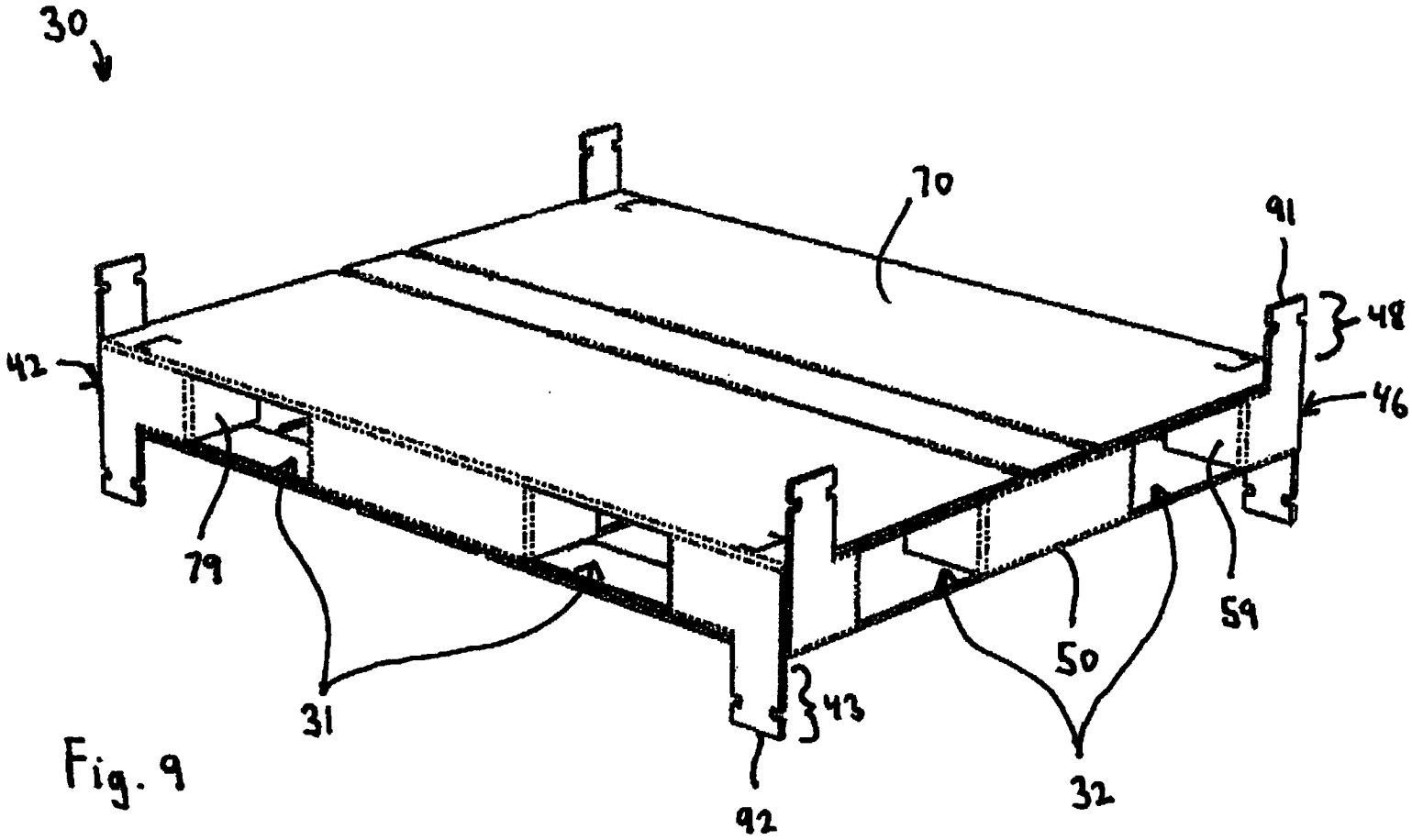
FIG. 9 is a schematic drawing of the pallet of FIG. 1 in the assembly process after the fork passages are folded open in accordance with the invention.

A schematic drawing of the pallet of FIG. 1 in the assembly process after the fork passages are folded open in accordance with the invention is shown in FIG. 9. The pallet 30 has pallet top 70 locked together with pallet bottom 50. The sidewalls 42, 46 are vertical as the horizontal flaps 43, 48 are locking the edges of the ribs 51, 71. Vertical flaps 59, 79 are folded inward defining fork passages 31, 32. The vertical flaps 59, 79 also thereby lock the horizontal flaps 43, 49 from opening.

Figure 10:
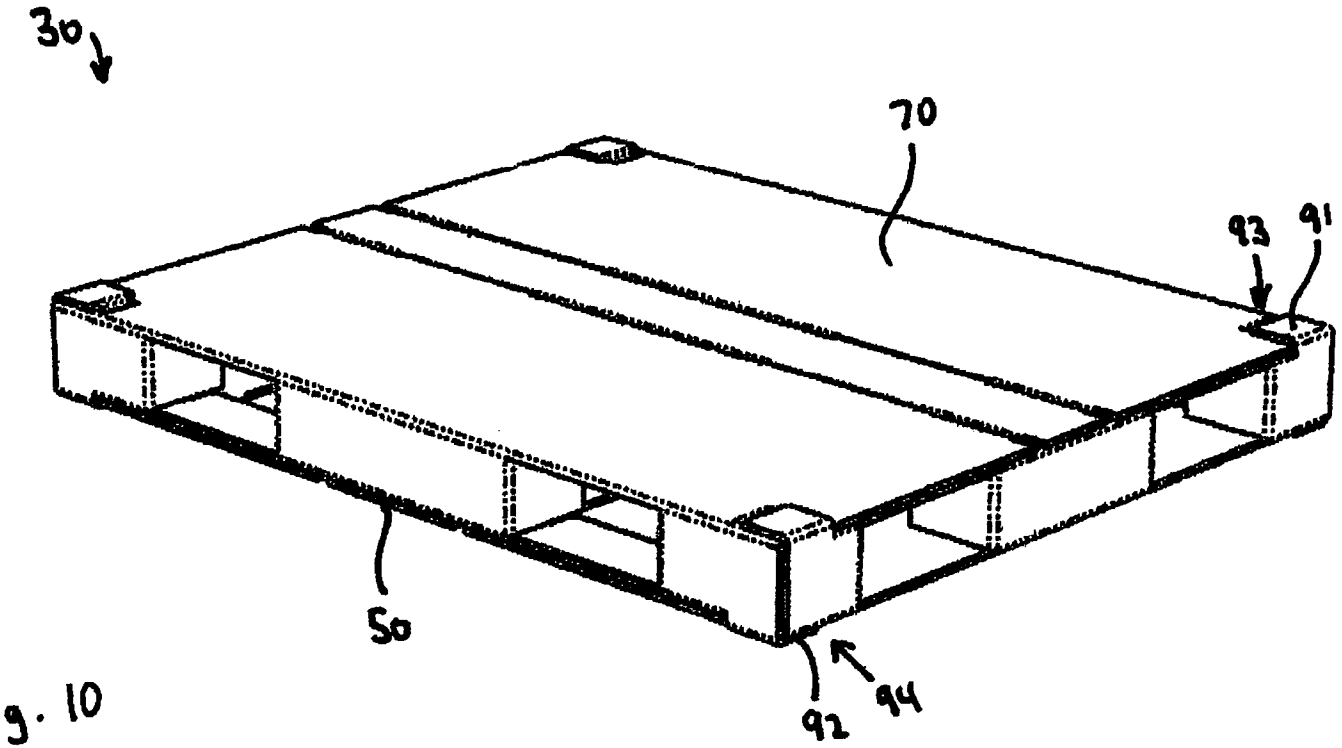
FIG. 10 is a schematic drawing of the pallet of FIG. 1 in the assembly process after the top and bottom locking straps are folded over in accordance with the invention.

The final assembly step is locking the corners of the pallet 30. A schematic drawing of the pallet of FIG. 1 in the assembly process after the top and bottom locking straps are folded over in accordance with the invention is shown in FIG. 10. The pallet 30 is completed with pallet top assembled together with pallet bottom. The corners 91, 92 of the horizontal flaps 42, 46 overlap the pallet top 70 and pallet bottom 50 and lock into the pallet top and the pallet bottom from the top and bottom surfaces of the pallet 30. The corner straps 91, 92 lock into slots 93, 94.

Figure 11:
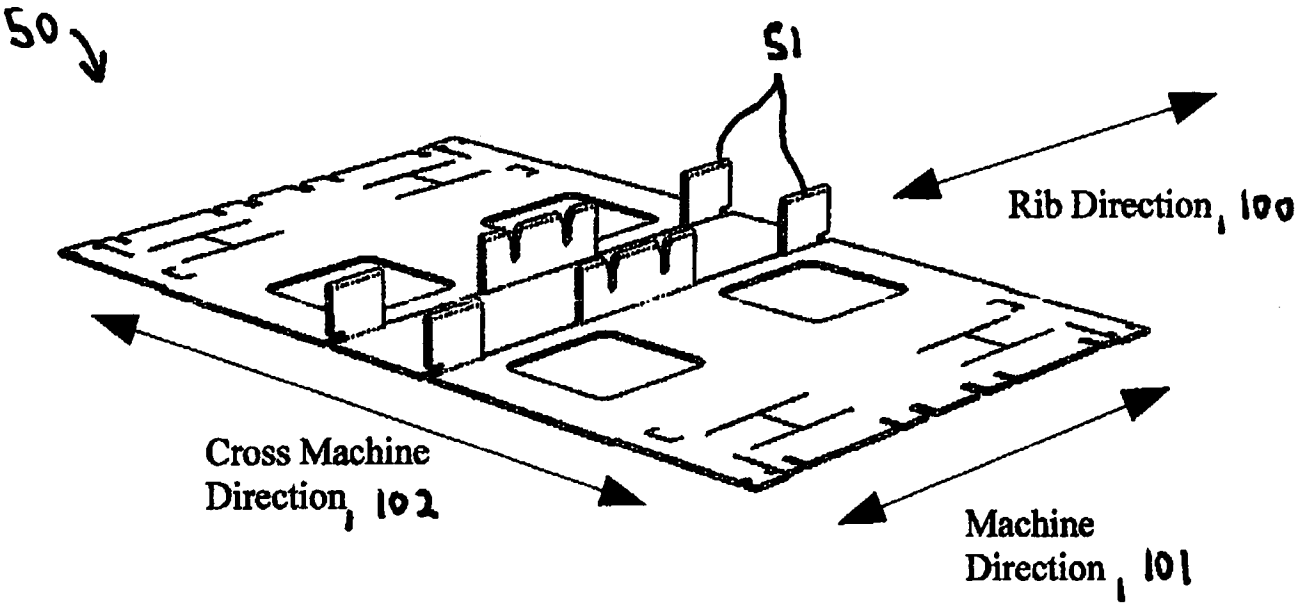
FIG. 11 is a schematic drawing of the pallet bottom of the pallet of FIG. 1 marked showing the corrugation directions with respect to rib direction, in accordance with the invention.

Corrugated paperboard is constructed with two directions; machine direction which is the direction it is pulled during fabrication and cross machine direction which is perpendicular to it, and is the axial direction of the flutes inside the corrugated paperboard. A schematic drawing of the pallet bottom of the pallet of FIG. 1 marked showing the corrugation material directions with respect to rib direction, in accordance with the invention is shown in FIG. 11. In order to provide maximum load capacity for the pallet 30 and transfer of load between the pallet top and pallet bottom 50, the cross machine direction 102 is preferably perpendicular to the rib direction 100.

Figure 12:
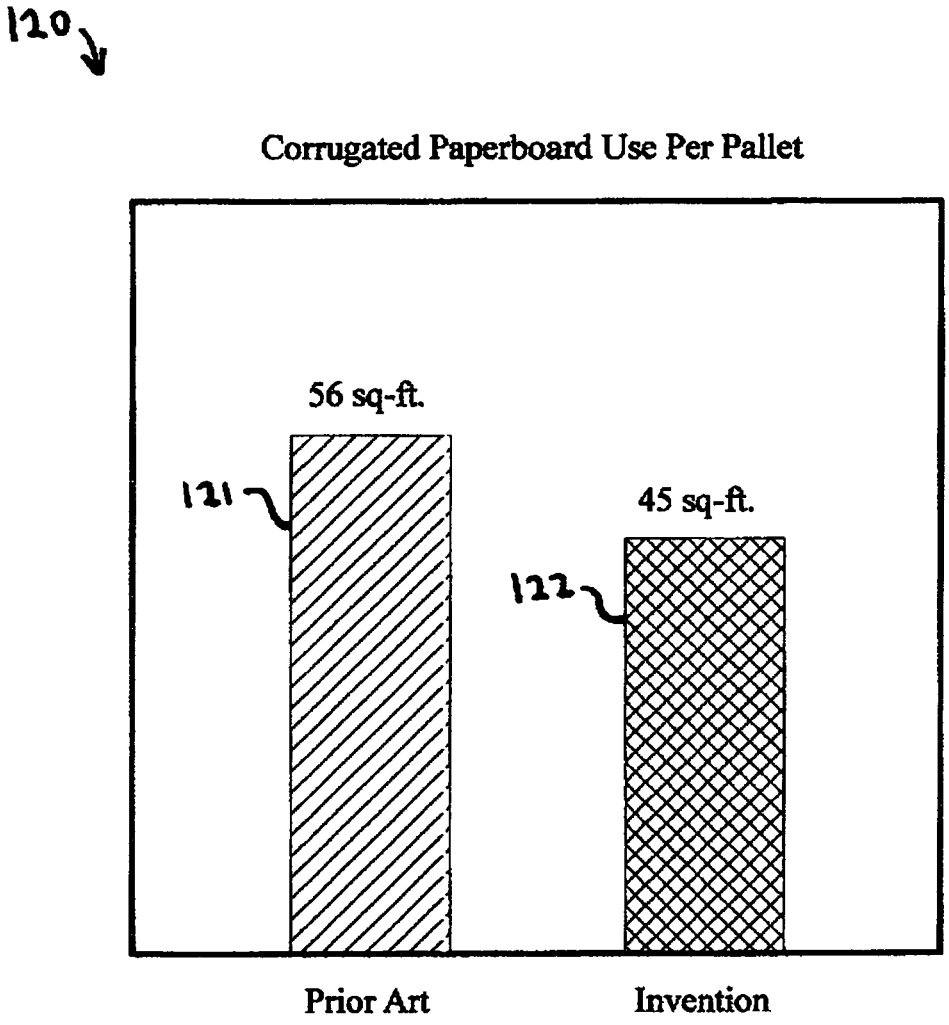
FIG. 12 is a comparison of the corrugated paperboard use per pallet between the prior art and the invention.

Although many corrugated pallets are designed using a high amount of corrugated paperboard, the invention even provides substantial savings compared to lighter two piece type corrugated pallets. A comparison of the corrugated paperboard use per pallet between the prior art two piece pallet and the invention is shown in FIG. 12. The corrugated paperboard use per pallet is shown with a prior art four-rib per blank pallet 121 using 56 sq-ft compared to a 20% reduction for the invention 122 at 45 sq-ft. This directly translates to a 20% reduction in raw material costs.

Figure 13:
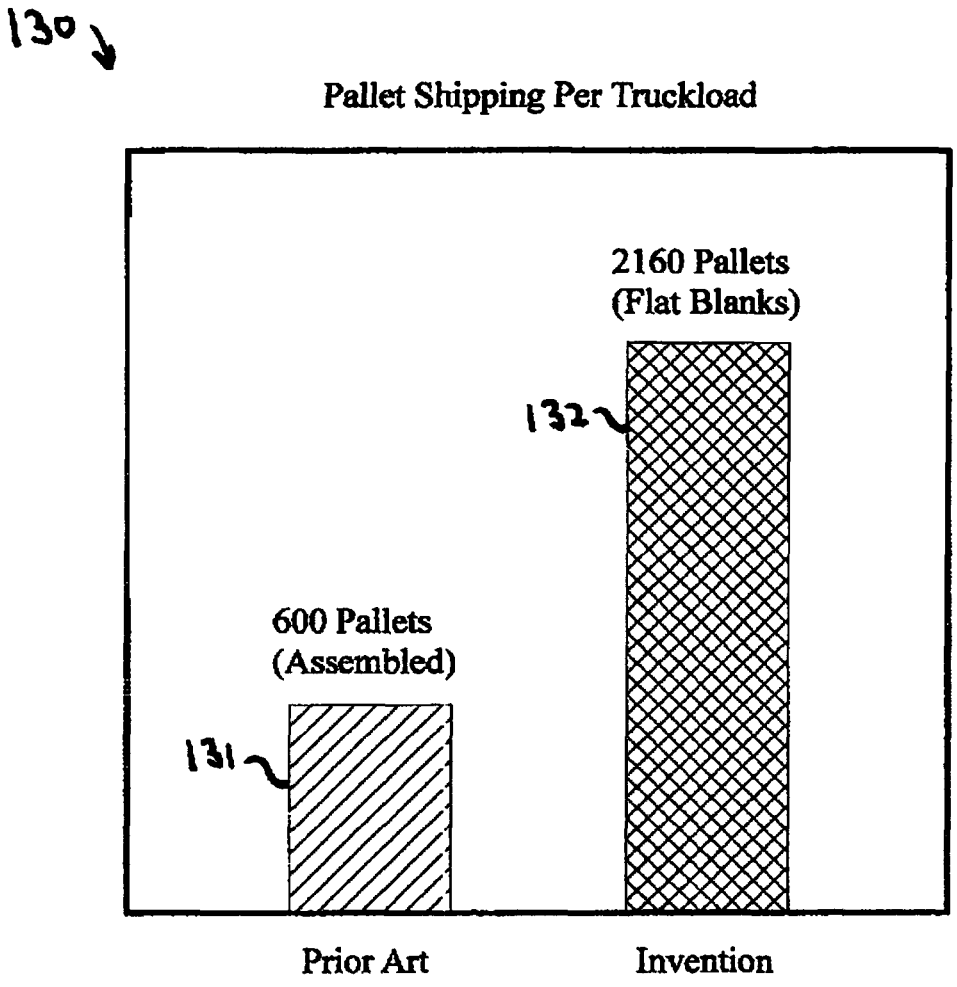
FIG. 13 is a comparison of the pallet shipping per truckload between the prior art and the invention.

One of the most significant benefits of the invention is that the blanks can be shipped flat and be easily assembled on site at a shipper, compared to prior art corrugated pallets that must be preassembled at an outside plant due to complexity. This greatly increases the number of pallets that can be shipped per truckload. The blanks may also be shipped directly from a corrugator or sheet plant to a product shipper without secondary transportation and logistics. A bar chart shown in FIG. 13 shows a comparison of the pallet shipping per truckload between the prior art and the invention. The pallet shipping per truckload for prior art preassembled pallets 131 is roughly 600 pallets. The pallet shipping per truckload with the invention 132 is 2160. This ability directly translates to lower shipping and handling costs from both more pallets per truckload and from preferably only shipping blanks directly to the product shipper.

Figure 14:
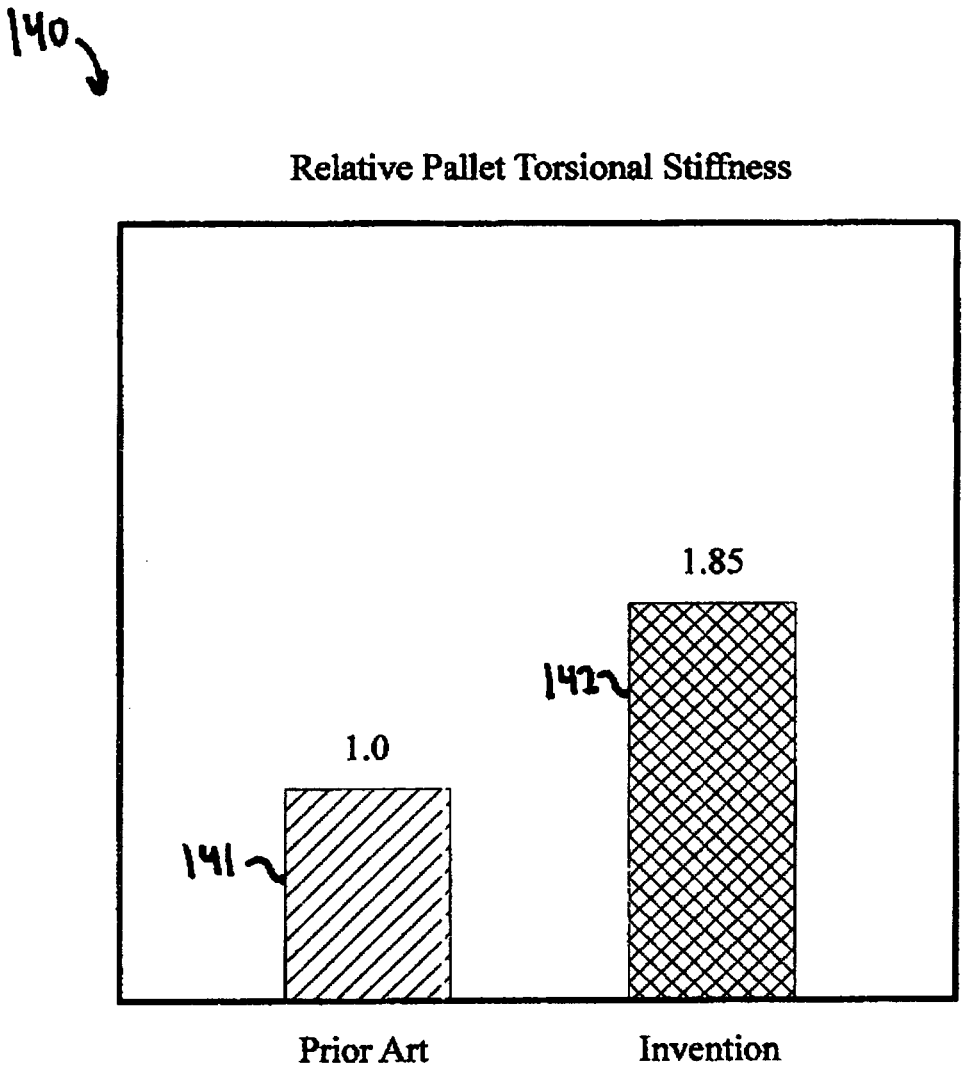
FIG. 14 is a comparison of the relative pallet torsional stiffness between the prior art and the invention.

Besides the cost savings, the invention also provides a stronger and stiffer pallet with increased reliability. A bar chart shown in FIG. 14 shows a comparison of the relative pallet torsional stiffness between the prior art and the invention. The relative pallet torsional stiffness is increased by about 85% in the invention 142 in comparison with a prior art two piece pallet without corner straps 141. During vibration as well as lifting of highly unbalanced loads, the invention is much more likely to perform without failure or separation of the pallet top and pallet bottom.

Obviously, numerous modifications and variations of the described preferred embodiment are possible and will occur to those skilled in the art in light of this disclosure of the invention. Accordingly, I intend that these modifications and variations, and the equivalents thereof, be included within the spirit and scope of the invention as defined in the following claims, wherein

We claim:

1. A pallet produced from two flat blanks of corrugated paperboard which comprise a pallet top and a pallet bottom;

said blanks are each folded to produce only two parallel vertically extending double thickness ribs, three horizontal panels, two vertical side walls and two horizontal flaps;

in each of said blanks, one of said horizontal panels lies between said ribs and the other two horizontal panels lie on opposite sides of said two ribs, respectively;

said vertical side walls of each said blank are attached to outer edges of said other two horizontal panels;

said horizontal flaps on each blank are attached distal ends of said vertical side walls, respectively;

said ribs of said pallet top and said pallet bottom lock each other from opening in the center of the pallet by intersecting perpendicularly with notches;

said horizontal flaps lock said ribs from opening at the edges of said pallet by intersecting said ribs perpendicularly with notches in said horizontal flaps, and said vertical side walls comprise vertical flaps, each having one end attached to said side walls and an opposite end free, and top and bottom edges cut so said flaps can open inward defining fork passages whereby said vertical flaps engage inner surfaces of one or both of said pallet top and bottom to lock said horizontal flaps from opening.

2. A pallet as defined in claim 1 wherein:

said vertical flaps of said side walls provide transfer of load between the said pallet bottom and said pallet top.

3. A pallet as defined in claim 2 wherein:

said pallet top and said pallet bottom each have a non-crushed total flute thickness of greater than 5.6 mm and each of said pallet top and said pallet bottom has an outside width between said ribs that is greater than $1/8^{th}$ the outside width between their respective side walls.

4. A pallet as defined in claim 3 wherein:

adjacent panels of said three horizontal panels of said pallet top and said pallet bottom abut each other without overlapping and said ribs are locked free of adhesive.

5. A pallet as defined in claim 1 wherein:

corners of said horizontal flaps overlap said horizontal panels and lock into outer horizontal surfaces of said pallet.

6. A corrugated paperboard pallet as defined in claim 1 wherein:

said pallet top and said pallet bottom each have a cross machine direction of the corrugations in said corrugated paperboard, which are perpendicular to the direction of their respective ribs.

7. A pallet as defined in claim 6 wherein:

a portion of said horizontal flaps overlap portions of said horizontal panels and lock into outer horizontal surfaces of said pallet.

8. A pallet produced from two flat blanks of corrugated material which comprise a pallet top and a pallet bottom;

said blanks are each folded to produce no more than two vertically extending double thickness ribs attached to no more than three horizontal panels, two vertical side walls attached to said horizontal panels on opposite sides of said pallet, and two horizontal flaps attached to distal ends of said side walls;

said ribs of said pallet top and said pallet bottom extend perpendicularly to each other, respectively, and each have notches which engage and lock each other from opening in the center of said pallet;

said horizontal flaps are folded and tucked into interior spaces on opposite sides of said pallet and have notches that engage base portions of said double thickness ribs to lock said ribs from opening at edges of said pallet, and a portion of said horizontal flaps fold over and overlap portions of said horizontal panels and lock into outer horizontal surfaces of said pallet.

9. A pallet as defined in claim 8 wherein:

said vertical side walls comprise vertical flaps that open inward defining fork passages whereby said vertical flaps lock said horizontal flaps from opening.

10. A pallet as defined in claim 9 wherein:

said vertical flaps of said side walls provide transfer of load between the said pallet bottom and said pallet top.

11. A pallet as defined in claim 8 wherein:

said pallet includes two double thickness ribs folded from each pallet blank, and three horizontal panels, wherein adjacent panels of said three horizontal panels of said pallet top and said pallet bottom abut each other without overlapping and said ribs are locked in folded position free of adhesive.

12. A pallet as defined in claim 8 wherein:

said corrugated material has a cross machine direction of the corrugation of said pallet top and said pallet bottom which is perpendicular to the direction of their respective ribs.

13. A pallet as defined in claim 12 wherein:

said pallet top and said pallet bottom each have a non-crushed total flute thickness of greater than 5.6 mm and each of said pallet top and said pallet bottom has two ribs folded therefrom positioned such that an outside width between said ribs is greater than $1/8^{th}$ the outside width between their respective side walls.

14. A pallet produced from two flat corrugated paperboard blanks which comprise a pallet top and a pallet bottom;

said blanks are each folded to produce only two parallel vertically extending double thickness ribs, with the ribs on one blank lying perpendicular to the ribs on the other blank, said blanks are each folded to produce one horizontal panel between said ribs and two horizontal panels, one each on each of opposite sides of said ribs, and two vertical side walls, one each attached to each of said two horizontal panels and spaced an outside width apart, and two horizontal flaps on distal ends of said side walls;

said ribs of said pallet top and said pallet bottom each have vertically opening notches which lock each rib from opening in the center of the pallet by when said notches are nested perpendicularly with each other;

said horizontal flaps have notches which lock said ribs from opening at the edges of said pallet by intersecting said ribs with said notches, and said pallet top and said pallet bottom each have a non-crushed total flute thickness of greater than 5.6 mm and each of said pallet top and said pallet bottom has an outside width between said ribs that is greater than $1/8^{th}$ said outside width between their respective side walls.

15. A pallet as defined in claim 14 wherein:

said pallet top and said pallet bottom each have a cross machine direction of the corrugation of said pallet top and said pallet bottom, which is perpendicular to the direction of their respective ribs.

16. A pallet as defined in claim 15 wherein:

said vertical side walls comprise vertical flaps attached at one edge that swing inward defining fork passages, whereby said vertical flaps are dimensioned so as to engage inside surfaces of said pallet top and said pallet bottom to lock said horizontal flaps from opening.

17. A pallet as defined in claim 16 wherein:

said vertical flaps of said side walls provide transfer of load between the said pallet bottom and said pallet top.

18. A pallet as defined in claim 14 wherein:

a portion of said horizontal flaps overlaps portions of said horizontal panels and lock into outer horizontal surfaces of said pallet.

19. A pallet as defined in claim 18 wherein:

the corners of said horizontal flaps overlap portions of said horizontal panels and lock into outer horizontal surfaces of said pallet.

20. A pallet as defined in claim 14 wherein:

adjacent panels of said three horizontal panels of said pallet top and said pallet bottom abut each other without overlapping and said ribs are locked without the use of adhesive.

21. A pallet produced from first and second flat corrugated paperboard blanks which comprise a pallet top and a pallet bottom, comprising:

said blanks are folded to produce vertically extending double thickness ribs numbering no more than two on each blank, and two vertical side walls spaced an outside width apart, and two horizontal flaps attached to distal ends of said side walls;

said double thickness ribs on said first and second blank lying perpendicular to each other;

portions of each of said blanks engaging the other of said blanks to form geometrical mechanical locks that hold said pallet top and said pallet bottom in an integral locked-together pallet; with said ribs and said side walls providing locked support for loads on said pallet top at least some of said locks arranged in series of at least three locks, such that a first lock is in turn locked against disengaging by a second lock, and the second lock is in turn locked against disengaging by a third lock, and disassembly could occur only in a reverse sequence.

22. A corrugated paperboard pallet produced from two flat blanks which comprise a pallet top and a pallet bottom;

said blanks are each folded together to produce said pallet wherein folds on each pallet blank include double thickness ribs and two side walls that are locked from unfolding by serial geometric mechanical locks having a series of greater than two;

wherein on each blank said double thickness ribs are held in folded position by a first lock, and said two side walls are held in folded position by a second lock which also holds said first lock in locking position.

23. A corrugated paperboard pallet as defined in claim 22 wherein:

said blanks are each folded to produce only two parallel vertically extending double thickness ribs, three horizontal panels attached to said ribs, two vertical side walls attached to said panels, and two horizontal flaps attached to said side walls;

said serial geometric mechanical locks including 1) corner straps that lock said top and bottom blanks in a fixed spaced position relative to each other, and 2) notches on a center portion of ribs folded from said top and bottom blanks and intersecting perpendicularly, with said notches of said top and bottom ribs engaged with each other, and 3) said pallet top and bottom, said ribs lying perpendicular to each other and said notches engaged with each other to hold said ribs from opening.

24. A pallet as defined in claim 21, wherein said first lock includes first portions of one pallet blank which extend into an interior space of said pallet and engage base parts of a double-thickness rib formed in the other pallet blank to hold said rib closed against opening and spreading out flat;

said second lock includes second portions of said one pallet blank which extend into said interior space of said pallet and jam said first portions in place and prevent said first portion from dislodging form its position locking said ribs closed;

said third lock including portions of said top blank that lock into said pallet bottom to lock said pallet top and said pallet bottom tightly in a fixed spaced-apart position to hold said second portions in position against from retracting from the locking position thereof and allowing said first lock to open.

* * * * *